United States Patent [19]

Moberly

[11] 4,336,663

[45] Jun. 29, 1982

[54] EARTH SCRAPER ASSEMBLY

[76] Inventor: Frank Moberly, P.O. Box 3212, Napa, Calif. 94558

[21] Appl. No.: 151,014

[22] Filed: May 19, 1980

[51] Int. Cl.[3] ..... E02F 3/62

[52] U.S. Cl. ..... 37/129; 180/208; 172/444; 414/481; 414/572

[58] Field of Search ..... 37/124 R, 126 R, 126 AE, 37/129, DIG. 1, DIG. 11, DIG. 14, 8; 172/444; 180/208; 414/481, 572

[56] References Cited

U.S. PATENT DOCUMENTS

| | | | |
|---|---|---|---|
| 2,956,353 | 10/1960 | Hanner et al. | 37/126 AE |
| 3,311,389 | 3/1967 | Barton et al. | 37/129 X |
| 3,314,494 | 4/1967 | Weitzner | 180/208 |
| 3,418,735 | 12/1968 | Martin | 37/129 |
| 3,449,845 | 6/1969 | Jessen et al. | 37/129 |
| 3,710,965 | 1/1973 | Joosten | 180/208 X |
| 3,969,835 | 7/1976 | Erdelyan | 37/129 |

*Primary Examiner*—E. H. Eickholt

*Attorney, Agent, or Firm*—Manfred M. Warren; Glen R. Grunewald; Robert B. Chickering

[57] ABSTRACT

A hoisting mechanism for earth scraping equipment adapted for towing behind a vehicle, such mechanism including a plurality of pivotally connected links designed to pivot the scraper bed about rear wheels in a manner that provides for change in elevation of the scraper without affecting the elevation of the towing tongue at the point of towing connection. The hoisting mechanism is readily adaptable to include a pressurized accumulator selectively activated by scraper level by means of a cam operated valve to absorb shock while being towed in an elevated position. Further, the hydraulics utilized to move the rear wall forward for ejecting collected earth are the same hydraulics utilized to draw the rear wheels into the scraper bed for making the scraper narrower and therefore suitable for highway travel.

14 Claims, 7 Drawing Figures

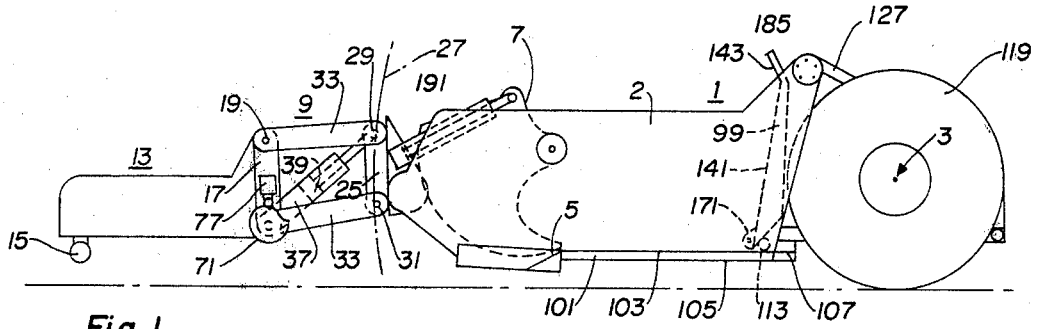
Fig. 1
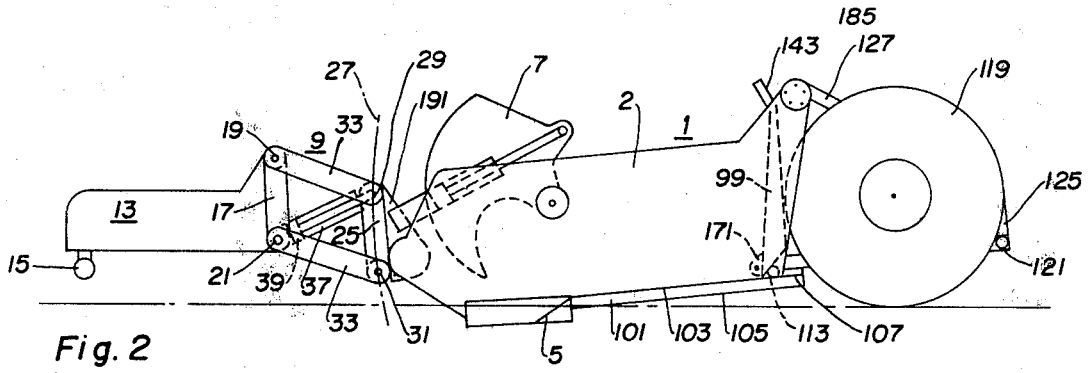
Fig. 2
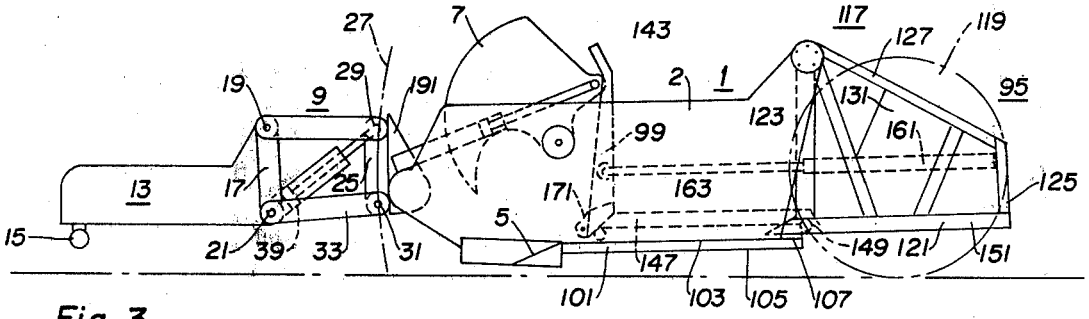
Fig. 3
Fig. 5
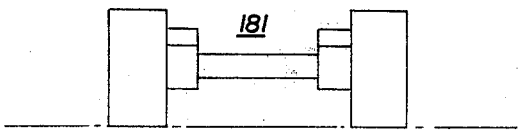
Fig. 4
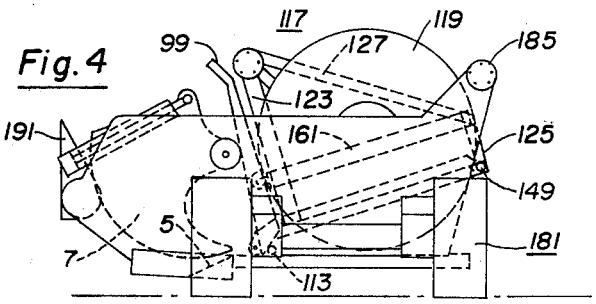

EARTH SCRAPER ASSEMBLY

The invention relates to earth scrapers in general and more particularly to the type adapted for towing behind a vehicle and which include a blade for scraping the earth and a bed for collecting the scraped earth.

Conventional equipment is designed to be transported generally by trailer from one scraping area to another and as such must be designed to be adaptable to the requirements of the road. Thus local road laws and regulations play an important part in the design of equipment that is generally designed to be used off the roads.

Greater efficiency is achieved by collecting a greater volume of scraped earth in the bed of a scraper. To achieve this end with a conventional scraper, because of the above transport design limitations, the earth must be piled high within the bed. This requires more work which translates to greater horse power demanded of the towing vehicle or, the scraper may be designed with a larger and lower bed for use when scraping and then manually disassembled for packing and transport.

A means for improving efficiency is to tow scrapers in tandem such that when the first scraper has been filled and the blade end hoisted to a higher, off the ground, carrying position, the rear scraper will be in position to continue scraping until it also is filled. However, in the hoisted position, the scraper presents a different load distribution on the towing tongue and has a tendency to affect the horizontal position of the scraper.

Also, while towing a loaded scraper in its hoisted position over rough ground, the oscillations that tend to occur can seriously effect its transportability by acting adversely upon the tongue of the scraper in a direction tending to fracture the tongue.

Among the objects of my invention are:

(1) To provide novel and improved earth scraping equipment;

(2) To provide novel and improved earth scraping equipment that may be hoisted above the scraping position without effecting the rear level of a towing tongue;

(3) To provide novel and improved earth scraping equipment that includes means for cushioning shock between a loaded scraper and a towing vehicle;

(4) To provide novel and improved earth scraping equipment with self contained means for reducing its size to facilitate highway transport;

(5) To provide novel and improved hoisting means for earth scraping equipment that can function equally well with a gooseneck assembly needed to eliminate the weight on a crawler tractor through use of a dolly.

Additional objects of my invention will be brought out in the following description of a preferred embodiment of the same, taken in conjunction with accompanying drawings, wherein FIG. 1 is a side view in elevation depicting the hoisting means of the invention maintaining the scraper in an earth hauling position;

FIG. 2 is a side view in elevation depicting the hoisting mechanism of the invention maintaining the scraper in an earth scraping position;

FIG. 3 is a side view in elevation depicting the invention in a spread and dump position with a front apron open and rear ejector wall in its foremost position;

FIG. 4 is a side view in elevation of the invention folded into a position for transport;

FIG. 5 is an end view in elevation of a trailer transporting dolly for use with the invention as shown in FIG. 4;

Figure 6:
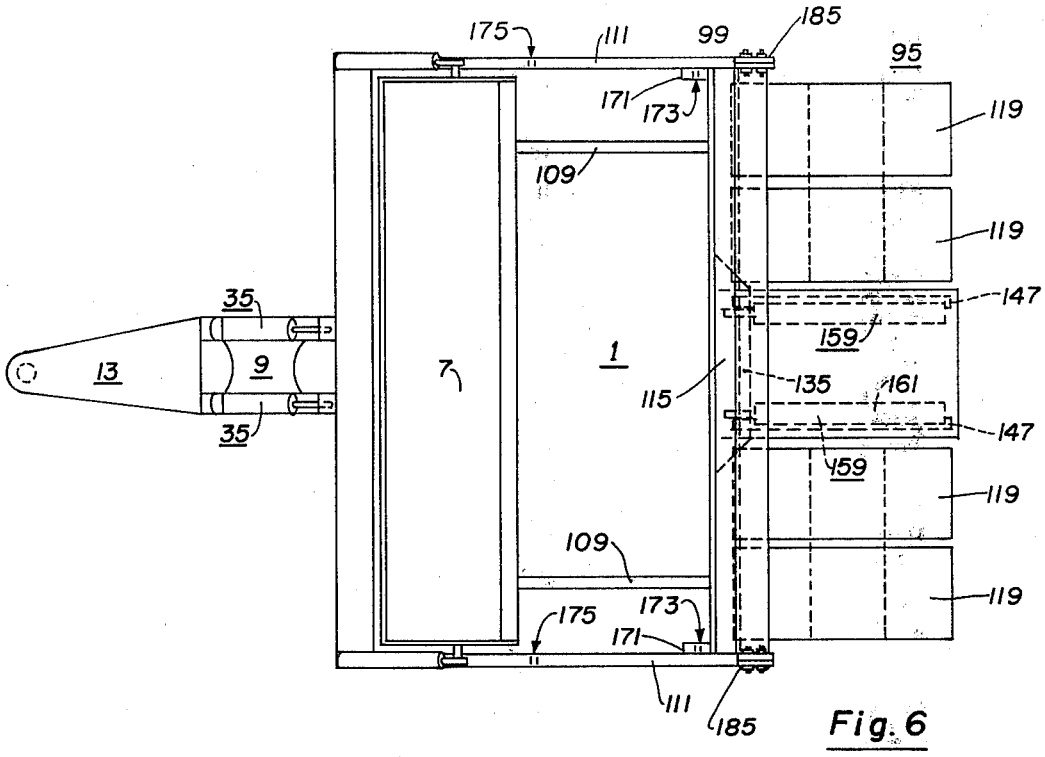
FIG. 6 is a plan view of the invention as shown in FIGS. 1 and 2.

Referring to the drawings for details of my invention in its preferred form, the scraper bowl assembly 1 comprises an earth carrying scraper bowl 2 rotatable about an axis 3 behind the bowl. The scraper bowl at its forward end includes a blade 5 for slicing into the earth to be scraped, an apron 7 for closing over the front of the scraper bowl to contain the earth collected therein, and a hoisting means in the form of an assembly 9 for raising and lowering the front end of the scraper bowl to put the blade into the path of the ground for scraping or alternatively above the ground for moving the contained earth. A tongue assembly 13, connected to the forward end of the hoisting means is designed for attachment to the draw bar of a towing tractor through a ball 15 and socket connection.

The hoisting means located between the scraper bowl and the tongue comprises an adjustable linkage assembly with a plurality of links pivotally connected by hinge pins. A forward upstanding link 17 is part of the tongue assembly and contains a top hinge point 19 and bottom hinge point 21 with the top hinge point 19 located in a more forward position than the bottom. A second smaller link 25 is located on the cord of an arc 27 struck about the rear pivot axis 3 behind the scraper bowl and includes a top and bottom hinge point 29, 31 located at both points where the link 25 intersects the arc. The two upper hinge points are pivotally connected and the two lower hinge points are pivotally connected by equal length links 33.

Hydraulic actuator assemblies 35, comprising hydraulic cylinders 37 with enclosed pistons 39, are connected between the lower front hinge pins 21 and the upper rear hinge pins 29 such that extension of the actuators increase the distance between diagonal corners of the hoisting assembly to which they are attached, thereby changing the angle between the corners and rotating the second link 25 upwardly around its prescribed arc with a subsequent raising the front of the scraper bowl.

The second link 25, being shorter than the first 17, causes a greater angle of connection between the hydraulic actuating means and the connected hinge point 29 to which the raising force is directed. The more closely the applied force approaches a direction perpendicular to the link, the larger the component of that applied force will be directed toward the movement of the link. Thus, the shorter the link the less force will be required to raise the front of the scraper.

Control of raising and lowering of the scraper is accomplished by means of a servo control spool valve assembly 41 of a conventional type that slidably connects different grooves within a valve spool with different openings within the valve body in various degrees of coincidence in response to electrical control by an operator at an operating console 43, whereby the operator of a vehicle towing the scraper may control the quantity and direction of pressurized fluid flow (source not shown) through the valve.

Raising the front of the scraper is accomplished by completing a flow path between the pressure line 45, through the spool valve 41, to the rear of the pistons 39 within the hydraulic cylinders 37. The same position of the spool valve also completes a flow path from the cylinder in front of the piston, through the valve 41, through a return flow path 49 to a tank reservoir (not shown) such that fluid under pressure is directed behind the piston to move it forward while fluid in front of the piston is directed to the tank. To lower the scraper towards a scraping position the spool valve is positioned at the direction of the operator to connect the pressure line 45 to the front of the cylinder and the back of the cylinder to the tank. Thus, the raising and lowering of the scraper from scraping position to transport position is readily controlled by an operator.

A load in the scraper may weigh many tons and any momentum built up in any direction other than forward by the towing vehicle, such as that caused by oscillations created by towing over rough terrain, should be cushioned as much as possible as this momentum acts adversely on the tongue of the scraper and the towing vehicle. For this reason, the hoisting mechanism as above described has been made to be readily adaptable to also function as a cushion hitch for absorbing the shock from undesirable bouncing movement by functioning as a shock absorbing mechanism.

To cushion the ride, the pressure side of the hydraulic cylinders supporting the weight of the upheld load, are exposed through a flow passageway 51 to an accumulator 53 containing fluid 57 held under pressure by a gas 59 under pressure acting against a piston 61 separating the gas and the fluid. Transient increases in pressure in the flow passageway 51 due to the heavy load causing bouncing over rough or uneven terrain, will be absorbed by the compressable gas in the accumulator through the uncompressable fluid connecting the accumulator with the hydraulic cylinders 35 supporting the load. It can readily be seen the amount of cushioning is dependant upon the prevailing pressure of the gas in the accumulator and this of course, is easily made variable by conventional means.

A fluid reservoir 65 is connected through a flow path 67 to the front of the hydraulic piston and allows this side of the piston to raise or lower without loss of fluid in the cylinder.

To prevent a high amplitude oscillation from bringing the front of the scraper down below a minimum level for towing and to prevent the cushioning feature from possibly allowing the gas to absorb enough pressure to allow the front of the scraper to contact the ground, it is necessary to include a means to gradually disable the cushioning feature and to isolate it completely when the scraper front approaches and goes below a certain adjustable minimum level.

Figure 7:
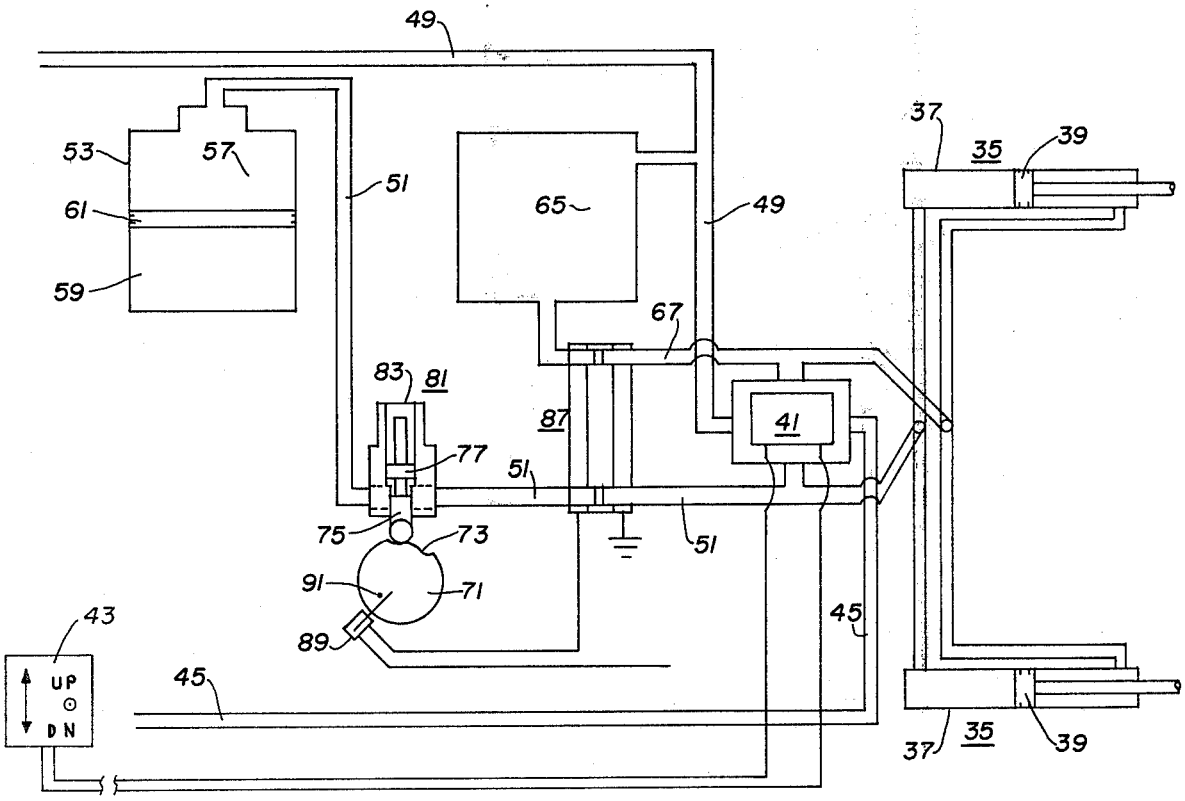
FIG. 7 is a schematic of a hydraulic system suitable for controlling all the manual and automatic functions of the preferred embodiment of the invention.

To this end, a disc 71 having a cam surface 73 is adjustably installed on a movable link 31 of the hoisting assembly. The movable cam surface is in contact with a follower arm 75 connected to a spool valve 77 installed on the upstanding non-movable first link 17 (FIG. 1) and adjustably controls the flow of oil through the flow passage 51 between the accumulator 53 and the hydraulic cylinders 35 based upon the angle of the movable link 33 with respect to the upstanding link 17 which is indicative of the elevation of the front of the scraper. The cushion valve assembly 81 comprises a valve body 83 enclosing a spool 77 attached to the cam follower 75. Adjustment of the cam will be such that the cushion valve will completely restrict flow therethrough when the scraper is below a certain elevation and progressively open as the scraper blade is raised (FIG. 7 depicts an intermediate position).

The gradual opening of the valve during initial raising of the scraper from a scraping to a towing position, allows a gradual equalization of the pressure within the accumulator to a prevailing pressure in the hydraulic cylinders.

It can be seen that the gradual decrease in the flow path through the valve as the front of the scraper is lowered during a transient bounce, will gradually close fluid access to the accumulator and slow the bounce down to a gradual stop at a point determined by the cam adjustment to prevent undershoot below a predetermined level.

An electrically operated off/on spool valve assembly 87 provides on/off flow through the flow passageways from both ends of the hydraulic cylinders 35 to the cushioning means 53. Electrical control of this valve is through a switch 89 located adjacent to the cam and operated by a switch activating member 91 located on the cam 73. With this valve 87 closed, all fluid in the circuit with the hydraulic cylinders is locked in place and the pistons within are prevented from movement in either direction not withstanding the degree of openness of the variable cushioning valve 81, thus providing a means for limiting the range of effectiveness of the cushioning feature and preventing it from becomming activated until the scraper has reached a predetermined height safe for towing.

It is necessary from time to time to transport the scraper assembly from one place to another using surface roads. The scraper assembly in its scraping condition is both too long and too wide to be lawfully transported thereon and some means of compacting its size is necessary. Rather than dismantling the scraper assembly to pack it on a trailer for shipment, a means has been devised for the scraper assembly to compact itself into a size that will allow it to be transported on such surface roads. Such a means includes utilizing existing hydraulic apparatus for retracting the overhanging rear wheel assembly 95 into the scraper bowl 2.

The scraper bowl assembly 1 includes a forward moving rear wall 99 with means for moving the wall forward from a normal rear position to forward position for ejecting material collected during scraping (FIG. 3).

The bowl bed 101 comprises two substantially parallel plates, a top and a bottom 103, 105, separated by a webbed support structure. The front of the plates are connected by an angled cutting edge blade 5 and the rear by a cross-support member 107. A pair of transverse ribs 109 parallel to and displaced inwardly from the sides 111, function as wear plates for carrier rollers 113 that support the movable rear wall.

A wheel bracket support 115 extends from the rear cross support member 107 of the bed and comprises a top plate strengthened by a plurality of ribs.

A wheel frame assembly 117 for supporting the rear wheels 119 comprises a horizontal tube main frame 121, and front and rear upstanding vertical support members 123, 125 with an angled top connecting plate 127 connecting the two vertical supports. An axial mounting plate 131 provides support for a centrally situated wheel axle 133 and a front wheel frame mounting plate 135 is fixed for releasable attachment to the wheel bracket support 115 of the bowl floor.

The movable rear wall 99 comprises a rearward gently sloped face plate 141 with a forward angled top section 143 supported and strengthened by cross-angled channels. Toward each end of the bottom section is rotatably fixed a rear wall carrier roller 113 in alignment with the transverse wear plates 109 of the bowl floor.

A horizontal guide assembly for the movable wall comprises a horizontal main arm tube 147 extending rearwardly from the bottom of the movable rear wall with a small axle at the far end rotatably supporting a lateral roller 149 enclosed within a roller guide rail 151 comprised of an internally opened channel fixed rearwardly along the horizontal main frame of the rear wheel assembly.

Movement of the rear wall is accomplished by means of a hydraulic ram assembly 159 attached between the back of the movable rear wall and the rear vertical support 125 of the wheel bracket assembly. This hydraulic ram comprises a cylinder 161 with an internal piston having a rod 163 extending forward and pivotally connected to the rear of the movable wall such that extension of the rod causes forward movement of the wall on the carrier rollers 113. Conversely, withdrawal of the rod back into the cylinder causes the wall to retract to its rearward position. The back end of the cylinder is pivotally connected to the rear vertical support.

Extending forward from the bottom of the movable wall on either side thereof is a wheel frame retract bracket 171 with a small opening 173 therethrough. In the foremost position of the movable wall this opening comes into alignment with a similar opening 175 in the side walls of the scraper bowl so that a pin placed through the coincident openings will maintain the movable wall in its forward position and not allow it to return rearward. At this time, to draw the rear wheels up into the bed, it is only necessary, after raising the scraper and placing a dolly assembly 181 beneath, to disconnect the rear wheel support frame by removing securing bolts from the rear bracket support and the securing bolts from a connection between the upper rearside walls 185 and the top of the upstanding initial support members 123. With the wheel frame thus disassociated from the scraper assembly, closing of the hydraulic ram will now move the rear wheels and wheel bracket assembly forward into contact with the rear of the bowl floor, with the guide rail moving upon the now stationary guide roller. Upon reaching the rear of the scraper floor, the wheels and the wheel bracket assembly will be rotated upward causing the movable rear wall to rotate forward about the point where it is pivotally pined to the side walls. The wheels will continue to be drawn into the bed of the scraper until the cylinder rod is enclosed within the cylinder and the wheel bracket vertical support is in a position proximate the tilted rear wall.

At this time the tongue or gooseneck assembly need only be dismantled from its front attaching bracket 191 and the overall width of the scraper will be reduced to where it will now be allowable for transport on a public road.

From the foregoing description of my invention in its preferred form, it will become apparent that the same is subject to alteration and modification, without departing from the underlying principles involved, and I do not desire to be limited in my protection to the specific details illustrated and described except as may be necessitated by the appended claims.

I claim:

1. Earth scraping equipment adapted for towing behind a vehicle, said earth scraping equipment comprising a scraper including a bed rotatable about an axis located behind said bed and including a forward projected blade at the forward end of said bed for slicing into the earth to be scraped, ground engaging support means behind said bed for rear rotatable support of said scraper, a front attachment assembly including a towing tongue having a towing end for connecting said scraper at said towing end to towing apparatus on such towing vehicle, and hoisting means for controlling the elevation of said blade and said scraper bed without altering the elevation of the towing end of said towing tongue, said hoisting means comprising an adjustable linkage assembly including a plurality of pivotally connected links of at least three different lengths, means for pivoting said links with respect to each other to change the angle between adjacent links, whereby said unequal lengths of said links increase the range of said hoisting limits without altering the elevation of said towing end of said towing tongue.

2. Earth scraping equipment in accordance with claim 1, characterized by said adjustable linkage assembly comprising a non-vertical, non-adjustable fixed link having a top and bottom hinge point fixed at the towing tongue end of said linkage assembly, a smaller movable second link connected to the front end of said scraper and including a corresponding top and bottom hinge point located on the chord of an arc about said rear pivot axis behind said bed, a pair of links of equal length pivotally connecting the top of said first link to the top of said second link and the bottom of said first link to the bottom of said second link forming four pivotal corners of pivotal link connections, pivoting means operating between diagonal corners of said link connection to change the angle between adjacent links and thereby change the spaced distance between opposite links while rotating said second link either upward or downwards about said arc while raising or lowering said blade of said earth scraping equipment.

3. Earth scraping equipment in accordance with claim 2, characterized by said pivoting means comprising a hydraulic cylinder assembly comprising a cylinder with an internal piston having an elongated rod extending beyond said cylinder, said cylinder fixed to one corner of said link connections and said piston rod pivotally fixed to said diagonal corner, means for controlling movement of said piston in both directions within said cylinder, by supplying fluid under pressure to said cylinder to one end or the other of said piston, said controlling means comprising a valve means under control of an operator for admitting fluid under pressure to the desired side of said enclosed piston to either expand or contract said assembly to cause movement of said second link on a chord about said arc.

4. Earth scraping equipment in accordance with claim 3, characterized by cushioning means utilizing said hoisting means to absorb shock and compensate for bouncing of said scraper attributed to travel of said scraper over uneven terrain, whereby, said hoisting means functions to cushion the ride of said scraper.

5. Earth scraping means in accordance with claim 4, characterized by means for allowing activation of said cushioning means when said scraper is in a raised position for towing and deactivation of said cushioning means when said scraper is in position for scraping.

6. Earth scraping means in accordance with claim 5, characterized by said cushioning means including flow passages connected to said hydraulic cylinders of said hoisting means, adjustable valve means within said flow passages for controlling flow through said passages and means for adjustably activating said valve means in response to change in elevation of said scraper bed.

7. Earth scraping equipment in accordance with claim 6, characterized by said cushion valve means flow connected to said hydraulic cylinder assembly and fixed to a stationary part of said linkage assembly, said cushion valve means adjustably operated by a cam adjustably fixed to a movable link on said hoisting means and including said cushion valve adjustably controlling fluid flow to and from said hydraulic cylinder assembly in response to movement of said cam fixed to said movable link whereby, degree of opening of said valve means is proportional to the elevation of said scraper and said valve will isolate said cushioning means when said blade end of said scraper goes below an adjustable minimum level.

8. Earth scraping equipment in accordance with claim 7, characterized by said cushioning means including a cushioning fluid reservoir, said reservoir including a pressurizing means to establish pressure on said fluid whereby, when said scraping equipment is in a raised position for towing and said cam allows said cushion valve to open a path between said reservoir and said hydraulic cylinder assembly, said pressurizing means allows said hydraulic cylinders to operate by absorbing encountered shocks.

9. Earth scraping equipment in accordance with claim 8, characterized by means for deactivating said cushioning means when said blade is in a scraping position, said deactivating means comprising an electrically controlled shut-off valve in said passageway from said hydraulic cylinders, said electrical control including a switch activated by said adjustable cam, when said cam indicates said scraper bed is below a certain level, said switch will actuate and close said valve.

10. Earth scraping equipment adapted for towing behind a vehicle comprising a scraper including a bed having an internal bed area and a forward projecting blade for slicing into earth to be scraped, ground engaging support means including rear wheels behind said bed for rear support of said scraper, means for moving said rear wheels to a location within said bed area to reduce the overall length of said earth scraping equipment to enable lateral transport on a roadway.

11. Earth scraping equipment in accordance with claim 10, characterized by said scraper bed including a rear wall with means for moving said wall from its normal position to provide space for said rear wheels.

12. Earth scraping equipment in accordance with claim 11, characterized by said ground engaging support means including an axle support assembly removably fixed to the rear of said bed said axle support assembly including an axle rotatably supporting rear wheels.

13. Earth scraping equipment in accordance with claim 12, characterized by said rear wall moving means including a hydraulic ram fixed between said movable wall and said axle support assembly whereby, extension of said hydraulic ram imparts movement to said movable wall whereby, forward movement of said movable rear wall along said scraper bed may eject any collected earth from said scraper bed.

14. Earth scraping equipment in accordance with claim 13, characterized by means for locking said movable rear wall in a forward position in said bed when said hydraulic ram is extended and means for detaching said axle support assembly from behind said scraper bed whereby, with said movable wall locked in a forward position and said axle support assembly detached from said scraper bed, retraction of said hydraulic ram will draw said axle support assembly with said rear wheels into said scraper bed for storage.

* * * * *